United States Patent [19]

Mitra

[11] 3,992,836

[45] Nov. 23, 1976

[54] CRANE

[76] Inventor: Pradip Kanti Mitra, 7646 Ardleigh St., Philadelphia, Pa. 19118

[22] Filed: Mar. 5, 1975

[21] Appl. No.: 555,396

[52] U.S. Cl. ..... 52/223 R; 52/731; 212/144

[51] Int. Cl.[2] ..... E04C 3/10

[58] Field of Search ..... 52/223 R, 223 L, 632, 52/731, 733, 291, 73, 225, 230, 723, 229; 212/144

[56] References Cited

UNITED STATES PATENTS 3,010,257 11/1961 Naillon ..... 52/225

3,266,051 8/1966 Attwood ..... 52/632 X

*Primary Examiner*—Price C. Faw, Jr.
*Assistant Examiner*—Carl D. Friedman
*Attorney, Agent, or Firm*—Woodcock Washburn Kurtz & Mackiewicz

[57] ABSTRACT

The boom of a crane is provided with a prestressing means to place the top of the boom in compression and the bottom of the boom in tension.

5 Claims, 5 Drawing Figures

CRANE

BACKGROUND OF THE INVENTION

This invention relates to cranes, and in particular, to pedestal mounted single boom cranes.

In the prior art, such cranes were normally used to lift five or six ton loads to a height of perhaps 70 feet. These cranes, as shown in FIG. 5 of the drawings, were tubular in section; the tube being made of a steel plate of perhaps ¼ inch thick, formed with slightly rounded corners and welded at one longitudinal edge as at 10 in FIG. 5. Structural plates were welded along one or more sides as indicated at 12, 14, 16 and 18. These plates extended various distances along the side portions of the tubular crane to compensate for the loads which could be expected. In practice, the length of the single boom is limited and standard sizes are 30, 40 and 50 feet.

A crane such as that shown in FIG. 1, comprises in addition to the boom 20, a mast 22, a pivot pin 24 about which the boom can pivot in a vertical arc for a distance of perhaps 70° (as indicated by the arrow A), and a stick cylinder 26 which is operative to move the boom in this arc. The mast itself can rotate in a horizontal plane about a fixed base. Toward the end of the boom is a pulley (not shown) about which is wound a cable 28 to support the load 30. The pedestal is provided with means for withdrawing and playing out the cable.

Considering the boom under the static load conditions shown in FIG. 1, the load would tend to bend the boom to the position shown in phantom lines. This position is shown exaggerated to illustrate the effects of the load. In addition to the external load shown at 30, the weight of the boom itself will tend to produce this condition.

In designing such boom in accordance with the prior art, material had to be provided to overcome the expected working stress. Not considering factors of safety, this working stress comprises the stress due to a load plus the stress due to a weight of the boom material. It is known in the prior art to make such booms of steel having a high yield stress on the order of 50,000 kips.

Such booms have been limited in length and capacity primarily because the mass of the boom increases tremendously as the length of the boom increases.

SUMMARY OF THE INVENTION

It is my desire to offset the forces due to self-weight in a boom of the type described, by prestressing the boom. This will reduce the amount of mass necessary to lift the same load at the same distance in comparison to a prior art conventionally designed boom. By decreasing the mass and increasing the capacity, I can more economically produce booms of the same length and further, I can increase the length of the booms beyond the existing limits of the booms known in the art.

In accordance with the preferred embodiment of my invention, I prestress longitudinally a tubular boom, so that there is a compressive stress in the upper plate and a tension in the lower plate, equal to the predicted tension in the upper plate and compressive stress in the lower plate due to the weight of the structural members making up the boom. I thereby increase the lifting capacity of a boom having the same physical characteristics as a conventionally made boom.

In addition, I provide means for offsetting the lateral bending forces in the boom and the bending forces in the anchor plates carrying the prestressing load laterally and transversely across the tubular boom.

Accordingly, it is an object of my invention to provide a lighter weight, longer, greater capacity, boom for cranes of the type described, than those available in accordance with the prior art designs.

This and other objects of my invention will become apparent from the following description with reference to the accompanying drawings.

DESCRIPTION OF THE PREFERRED EMBODIMENT

Figure 1:
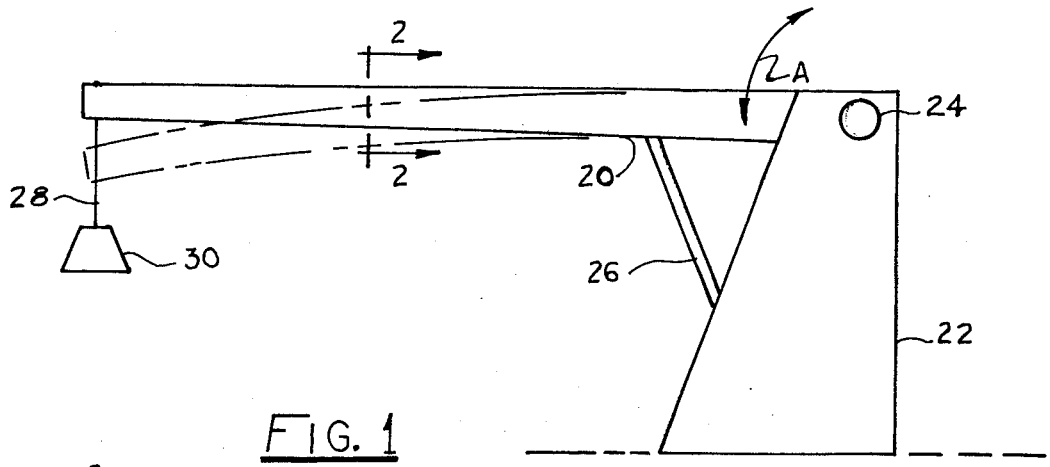
FIG. 1 is an elevation of a crane having a boom in accordance with the preferred embodiment of my invention; said crane having a load and an alternate phantom position shown for illustrative purposes.

Although specific forms of the invention have been selected for illustration in the drawings, and the following description is drawn in specific terms for the purpose of describing these forms of the invention, this description is not intended to limit the scope of the invention which is defined in the appended claims.

Figure 2:
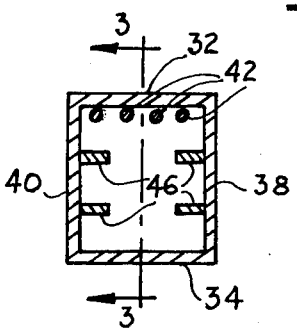
FIG. 2 is an enlarged section taken as indicated by the lines and arrows 2—2 in FIG. 1.
Figure 3:
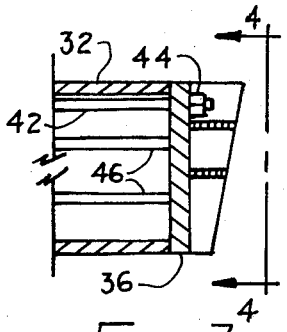
FIG. 3 is a foreshortened section taken proximate to the right hand end of the boom illustrated in FIG. 1 when viewed in the direction indicated by the lines and arrows 3—3 in FIG. 2.
Figure 4:
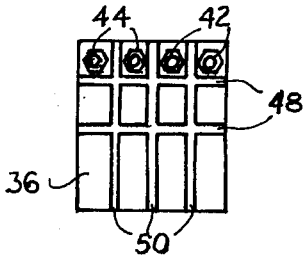
FIG. 4 is an end view taken as indicated by the lines and arrows 4—4 in FIG. 3.
Figure 5:
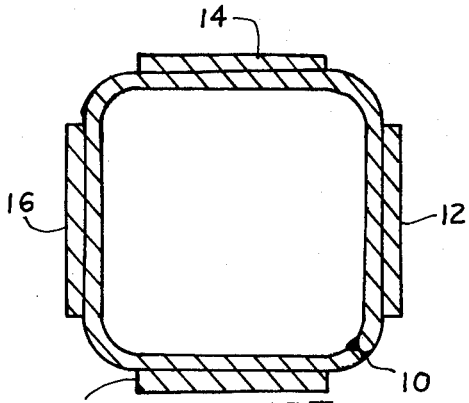
PRIOR ART FIG. 5
FIG. 5 is a greatly enlarged section similar to FIG. 2 showing the prior art tubular boom.

Referring particularly to FIGS. 2, 3 and 4, it will be noted that the corners are sharp. This is a license taken in presenting the drawings, which indeed are presented pictorially and schematically for purposes of illustration only. The general characteristics of the prior art pedestal mounted boom have already been described.

Referring to FIGS. 1 and 2, the tubular section of the boom is shown having an upper or first plate 32 and having spaced therefrom a lower or second plate 34. The first plate is normally under tension, causing it to bend downwardly, so that the boom tries to assume the position shown in phantom lines in FIG. 1. The lower plate is normally under compressive forces. These forces are due, as previously stated, to the load which is externally applied, as well as to the load due to the weight of the boom material. In order to offset this latter load, I have prestressed the boom. It is, of course, known to prestress materials and there is no claim that prestressing of materials per se is the invention which I seek to disclose and claim herein. Accordingly, for purposes of illustrating the preferred embodiment, the method of prestressing will be taken to be known generally; although, to my knowledge, it is not known in this art.

In order to effect the prestressing, anchor plates are provided, such as at 36 in FIGS. 3 and 4. These anchor plates are positioned most preferably proximate to the longitudinal ends of the boom. (This would be the right hand and left hand ends of the boom in FIG. 1.) Only the right hand end of the boom is shown in FIG. 3 for purposes of illustration. It should be noted that the anchor plates need not be at the extreme ends of the boom. The anchor plates may extend completely transversely and completely laterally of the boom. For purposes of definition herein, I will use the term "transversely" to mean passing at right angles to the plane of the upper and lower plates; this would be vertically on the drawings. I will use the term "laterally" to mean passing parallel to the upper and lower plates, but at a direction of right to left or left to right when viewed as in FIG. 2. The anchor plates, however, need not be attached to the plates 32 and 34, but may merely engage one or both of those plates. It is preferable to have them engage the upper plate 32. In this regard, it will be noted, then, that the anchor plate 36 does not need to extend fully to the bottom plate 34 as shown in the preferred embodiment.

In the construction of the hollow tubular boom shown, the side walls, such as 38 and 40, structurally connect the upper and lower plate 32 and 34, respectively, and form structural connecting means for forced transmission between the upper and lower plates. Thus, a compressive force exerted on the upper plate 32 will be transmitted by these side plates, so that a tensile force will be produced in the lower plate 34. For this reason, the anchor plates need not connect both upper and lower plates. Rather, all that is required is that the compressive force be applied at a location intermediate the plate to be prestressed in compression and the center of gravity of the unit. In the embodiment shown, that location is proximate to the underside of the upper plate 32.

The means for applying the prestressing is a plurality of cables 42 which are passed through holes in the anchor plates and which are fastened on opposite sides thereof by any suitable means, such as the anchors 44. Typically, one end of a cable would be anchored and the other end would be pulled by a hydraulic jack (as is well known in the art of prestressing), until the amount of predetermined stress had been exerted on the boom. At that point, the other end would also be anchored, so that the stress would be permanently induced or applied to the boom structure. While cables have been used in this description of the preferred embodiment, it will be understood that other prestressing members engaging the anchor plates could be provided within the scope of this invention.

To prevent lateral bending, I have provided stiffening means, comprising a plurality of longitudinally extending plate members connected to the structural connecting means 38 and 40 in any suitable manner, such as by welding. These stiffening means extend laterally substantially parallel to the upper and lower plates 32 and 34 respectively. They are spaced from those plates and inhibit the bending of the boom in the direction of the plane of their lateral extension; that is, they prevent bending in the horizontal plane when viewed as in FIG. 2.

To prevent yield or bending of the anchor plates, such as the plate 36 shown in FIG. 4, I have provided a plurality of stiffening members or ribs which extend longitudinally and which also extend laterally and transversely. In FIG. 4, these present a waffle appearance. As shown in FIG. 3, the lengths of these stiffening ribs vary, depending on the expected load. These stiffening ribs are attached to the anchor plates in any suitable manner and may be attached to one another in any suitable manner, such as by welding. Alternatively, they could be formed in the anchor plates themselves. By this means, bending of each of the plates with respect to its plane is prevented, and therefore, the prestressing applied to the boom remains constant.

It will be understood that various changes in the details, materials and arrangement of parts which have been herein described and illustrated in order to explain the nature of this invention may be made by those skilled in the art within the principle and scope of the invention as expressed in the following claims.

It will further be understood that the "Abstract of the Disclosure" set forth above is intended to provide a non-legal technical statement of the contents of the disclosure in compliance with the Rules of Practice of the United States Patent Office, and is not intended to limit the scope of the invention described and claimed herein.

What is claimed is:

1. An improved boom for a crane, comprising:

a. a hollow tubular member;

b. a longitudinally extending first plate and a longitudinally extending second plate spaced from first plate and structurally connected thereto by structural connecting means for force transmission therebetween;

c. anchor plates spaced from one another extending laterally and transversely of said boom and engaging at least said first plate for force transmission thereto;

d. prestressing means, comprising a plurality of prestressing members engaging said anchor plates and adjusted to exert a force on said anchor plates and said first plate to place said first plate in compression longitudinally and place said second plate in tension longitudinally by force transmission through said structural connecting means;

e. stiffening means comprising a plurality of longitudinally extending plate members connected to said structural connecting means and extending laterally substantially parallel to said first and second plates and being spaced therefrom, to inhibit bending of said boom in the direction of the plane of their lateral extension; and f. said first and second plates comprising upper and lower portions respectively of said hollow tubular member, said structural connecting means comprising the side portions of said hollow tubular member, and said stiffening means being provided within the enclosure of said hollow tubular member and extending inwardly from said side portions.

2. The invention of claim 1 wherein each of said anchor plates has connected thereto longitudinally and transversely extending ribs to prevent the bending of said plates out of their respective planes.

3. An improved crane having a prestressed boom, comprising:

a. a mast;

b. a boom mounted on said mast and means for moving said boom relative to said mast;

c. said boom comprising i. longitudinally extending first and second plates spaced from each other and structural connecting means for force transmission between said plates, said plates and connecting means defining a longitudinal hollow space within said boom;

ii. first and second anchor plates positioned at about opposite ends respectively of said boom, said anchor plates extending transversely of said boom and engaging at least said first plate; and iii. prestressing means for placing said first plate in compression longitudinally and said second plate in tension longitudinally, comprising a plurality of prestressing cables positioned within said defined longitudinal space and connected to said anchor plates rear said first plate so as to exert a compression force on said first plate and place said second plate in tension longitudinally by force transmission through said structural connecting means.

4. The crane as described in claim 3, wherein said anchor plates connect said first and second plates and have ribs which intersect at right angles.

5. The crane as described in claim 3, comprising a plurality of connecting elements for connecting each of said cables to said anchor plates, and wherein each said connecting element is separated from any adjacent element by one of said ribs.

* * * * *